US005989470A

United States Patent [19]

Doan et al.

[11] Patent Number: 5,989,470

[45] Date of Patent: Nov. 23, 1999

[54] METHOD FOR MAKING POLISHING PAD WITH ELONGATED MICROCOLUMNS

[75] Inventors: Trung Tri Doan; Scott G. Meikle, both of Boise, Id.

[73] Assignee: Micron Technology, Inc., Boise, Id.

[21] Appl. No.: 08/904,657

[22] Filed: Aug. 1, 1997

Related U.S. Application Data

[62] Division of application No. 08/723,901, Sep. 30, 1996, Pat. No. 5,795,218.

[51] Int. Cl.[6] ..... B32B 31/06; B29C 31/08; B29B 17/00

[52] U.S. Cl. ..... 264/261; 264/277; 264/279.1; 264/317; 264/344

[58] Field of Search ..... 451/526, 921, 451/533, 536, 538, 285–289, 41; 264/261, 271.1, 275, 277, 279.1, 232, 344, 221, 317

[56] References Cited

U.S. PATENT DOCUMENTS

| | | | |
|---|---|---|---|
| 5,020,283 | 6/1991 | Tuttle | 51/209 |
| 5,216,843 | 6/1993 | Breivogel et al. | 51/131.1 |
| 5,297,364 | 3/1994 | Tuttle | 51/209 |
| 5,421,769 | 6/1995 | Schultz et al. | 451/287 |
| 5,533,923 | 7/1996 | Shamouillan et al. | 451/41 |
| 5,584,146 | 12/1996 | Shamouillan et al. | 51/293 |

*Primary Examiner*—Jan H. Silbaugh
*Assistant Examiner*—Suzanne E. Mason
*Attorney, Agent, or Firm*—Seed & Berry, LLP

[57] ABSTRACT

A polishing pad for use in chemical-mechanical planarization (CMP) of semiconductor wafers includes a multiplicity of elongated microcolumns embedded in a matrix material body. The elongated microcolumns are oriented parallel to each other and extend from a planarizing surface used to planarize the semiconductor wafers. The elongated microcolumns are uniformly distributed throughout the polishing pad in order to impart uniform properties throughout the polishing pad. The polishing pad can also include elongated pores either coaxial width or interspersed between the elongated microcolumns to provide uniform porosity throughout the polishing pad.

8 Claims, 3 Drawing Sheets

METHOD FOR MAKING POLISHING PAD WITH ELONGATED MICROCOLUMNS

CROSS-REFERENCE TO RELATED APPLICATION

This application is a division of U.S. patent application Ser. No. 08/723,901, filed Sep. 30, 1996, U.S. Pat. No. 5,795,218.

TECHNICAL FIELD

The present invention relates to polishing pads used in chemical-mechanical planarization of semiconductor wafers, and, more particularly, to polishing pads with elongated microcolumns embedded in the bodies of the pads.

BACKGROUND OF THE INVENTION

Chemical-mechanical planarization ("CMP") processes remove materials from the surface layer of a wafer in the production of ultra-high density integrated circuits. In a typical CMP process, a wafer presses against a polishing pad in the presence of a slurry under controlled chemical, pressure, velocity, and temperature conditions. The slurry solution has abrasive particles that abrade the surface of the wafer, and chemicals that oxidize and/or etch the surface of the wafer. Thus, when relative motion is imparted between the wafer and the pad, material is removed from the surface of the wafer by the abrasive particles (mechanical removal) and by the chemicals in the slurry (chemical removal).

CMP processes must consistently and accurately produce a uniform, planar surface on the wafer because it is important to accurately focus optical or electromagnetic circuit patterns on the surface of the wafer. As the density of integrated circuits increases, it is often necessary to accurately focus the critical dimensions of the photo-pattern to within a tolerance of approximately 0.5 $\mu$m. Focusing the photo-patterns to such small tolerances, however, is very difficult when the distance between the emission source and the surface of the wafer varies because the surface of the wafer is not uniformly planar. In fact, several devices may be defective on a wafer with a non-uniform surface. Thus, CMP processes must create a highly uniform, planar surface.

In the competitive semiconductor industry, it is also desirable to maximize the throughput of the finished wafers and minimize the number of defective or impaired devices on each wafer. The throughput of CMP processes is a function of several factors, one of which is the rate at which the thickness of the wafer decreases as it is being planarized (the "polishing rate") without sacrificing the uniformity of the planarity of the surface of the wafer. Accordingly, it is desirable to maximize the polishing rate within controlled limits.

One problem with current CMP processes is that the polishing rate varies over a large number of wafers because certain structural features on the planarizing surface of the pad vary over the life of a pad. One such structural feature is the non-uniformity of the distribution of filler material throughout the pad. Prior art polishing pads typically are made from a mixture of a continuous phase polymer material, such as polyurethane, and a filler material, such as hollow spheres. Shown in FIG. 1 is a prior art polishing pad 10 having spheres 12 embedded in a polymeric matrix material 14. As can be seen, the spheres 12 have agglomerated into sphere clusters 16 before the matrix material 14 fully cured, resulting in a non-uniform distribution of the spheres 12 in the matrix material 14. Consequently, regions on the planarizing surface 18 of the polishing pad 10 at the sphere clusters 16 have a high polishing rate, while regions that lack spheres have a conversely low polishing rate. In addition, when using such a polishing pad 10 in a CMP process, the planarizing surface 18 is periodically removed to expose a fresh planarizing surface. The density of sphere clusters 16 vary throughout the thickness of the polishing pad 10, thereby causing the polishing pad 10 to exhibit different polishing characteristics as layers of planarizing surfaces are removed. Although many efforts have been made to provide uniform porosity throughout the continuous phase material, many pads still have a non-uniform porosity on their planarizing surface. Moreover, the non-uniform areas of the pad are not visibly distinguishable from other areas on the pad, making it difficult to detect and discard unacceptable pads.

SUMMARY OF THE INVENTION

One aspect of the present invention is directed to a CMP polishing pad having elongated microcolumns positioned within a matrix body. Preferably, the elongated microcolumns are oriented parallel to each other and extend from a planarizing surface used to planarize semiconductor wafers. In one embodiment, the microcolumns are hollow such that each microcolumn has an outer support tube surrounding an elongated pore. In another embodiment, the elongated microcolumns are interspersed with and parallel to elongated pores extending into the matrix body from the planarizing surface. In yet another embodiment, the elongated microcolumns are removed to result in a polishing pad with elongated pores extending from the planarizing surface into the matrix body. All of the embodiments preferably distribute the elongated microcolumns uniformly through the polishing pad, resulting in a polishing pad with uniform polishing properties throughout.

A second aspect of the invention is directed to a method of making a CMP polishing pad for planarizing semiconductor wafers. The method includes positioning the elongated microcolumns within a mold, placing a liquid matrix material within the mold such that the liquid matrix material extends between the microcolumns, and curing the matrix material to form a pad body. The liquid matrix material may be placed within the mold before or after the microcolumns are positioned within the mold. In one embodiment, each microcolumn includes an elongated central core of a first material positioned within an elongated outer tube of a second material and the method further includes exposing the pad body to a solvent material that removes the first material without removing the second material and the matrix material, and thereby creates elongated pores within the microcolumns. In another embodiment, a first set of the microcolumns made of a first material are interspersed with a second set of microcolumns made of a second material. The method exposes the pad body to a solvent material that removes the first material without removing the second material and the matrix material, and thereby creates elongated pores between the microcolumns of the second set.

Preferably, the microcolumns are positioned parallel to each other and transverse to a surface of the matrix material that, upon curing, becomes the planarizing surface for planarizing the semiconductor wafers. The microcolumns may be maintained in their parallel position by positioning the microcolumns within the mold as a bundle in which a connecting piece holds the microcolumns together. After the matrix material has cured, the connecting piece is detached from the microcolumns. Alternatively, the microcolumns can be maintained in a parallel orientation by extending the microcolumns through spaced-apart apertures in an alignment fixture with each microcolumn extending through a separate aperture.

DETAILED DESCRIPTION OF THE INVENTION

One aspect of the present invention is directed to a CMP polishing pad having elongated microcolumns positioned within a matrix body. The microcolumns are uniformly distributed throughout the polishing pad, resulting in uniform properties throughout the pad. In particular, the polishing pad is uniformly abrasive and porous throughout the planarizing surface of the polishing pad such that the polishing pad achieves a uniform polishing rate across the planarizing surface. In addition, the polishing rate achievable by the polishing pad remains stable throughout the life of the polishing pad. Further, the elongated microcolumns provide a polishing pad with more uniform porosity than the prior art polishing pads which results in a more uniform and stable polish of the semiconductor wafers.

Figure 1:
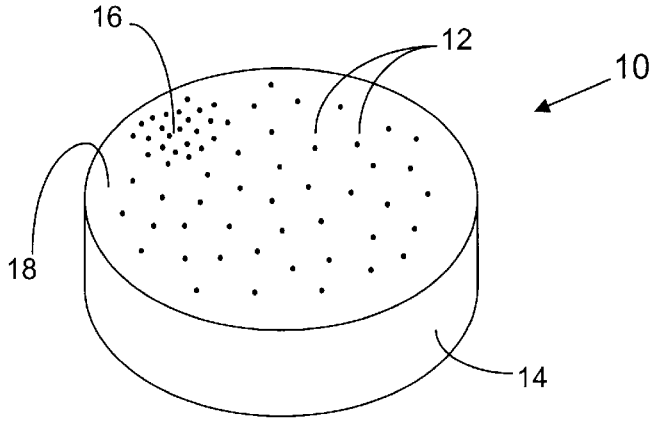
Figure 1 (Prior Art)
FIG. 1 is an isometric view of a prior art CMP polishing pad.
Figure 2:
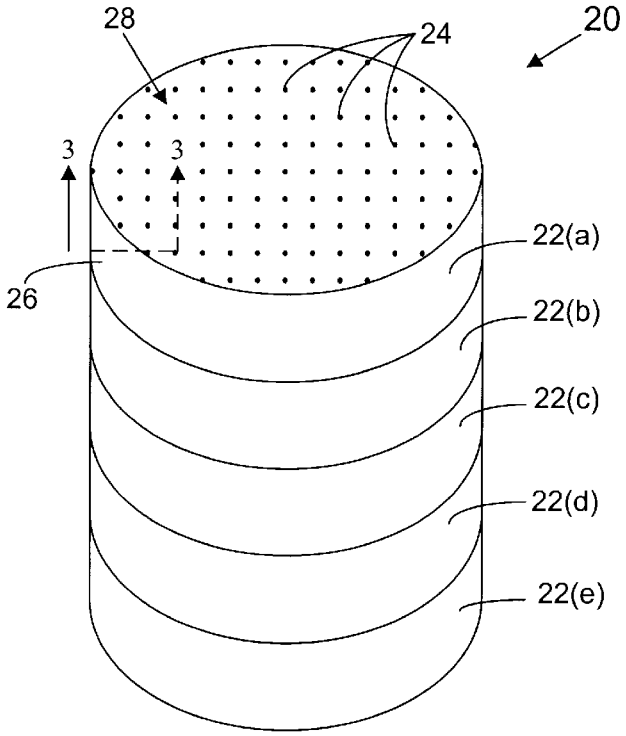
FIG. 2 is an isometric view of a cake of polishing pad material according to the present invention.

Shown in FIG. 2 is a polishing pad cake 20 from which a plurality of individual polishing pads 22(*a*)–22(*e*) are cut. The cake 10 includes a multiplicity of elongated microcolumns 24 embedded in a matrix material 26. The elongated microcolumns can be made of almost any substantially rigid material, such as fiberglass, silicon dioxide, or various polymeric materials. The matrix material 26 can be any polymeric material, such as polyurethane or nylon. The elongated microcolumns 24 extend inwardly from a flat planarizing surface 28 for planarizing the semiconductor wafers. The elongated microcolumns 24 preferably are uniformly straight and sufficiently rigid to remain parallel to each other substantially along the entire length of the microcolumns. The ability to maintain such a parallel orientation enables the elongated microcolumns 24 to be uniformly distributed throughout the entire polymer pad cake 20.

Figure 3:
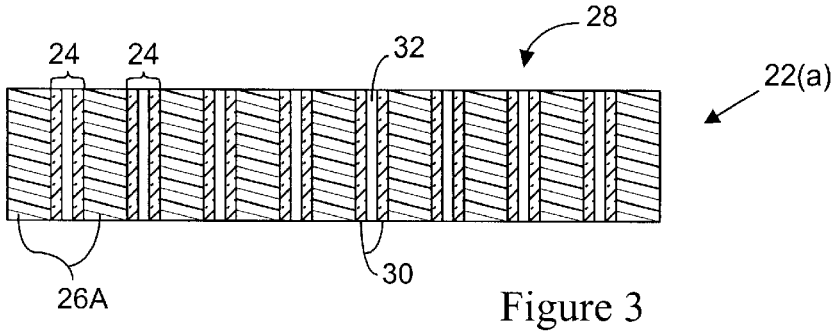
FIG. 3 is a partial cross-sectional view of a polishing pad taken along line 3—3 of FIG. 2.

A partial cross-sectional view of the polishing pad 22(*a*) is shown in FIG. 3. As can be seen, each of the elongated microcolumns 24 is hollow such that each microcolumn has an outer support tube 30 surrounding an elongated pore 32. The elongated microcolumns 24, including the elongated pores 32 within the microcolumns 24, extend entirely through the polishing pad 22(*a*) and perpendicular to the planarizing surface 28. Alternatively, the elongated microcolumns 24 could be made to extend from the planarizing surface 28 through the polishing pad 22(*a*) less than the full distance. Either way, the elongated pores 32 enable liquid used in the CMP process to be absorbed and distributed by the polishing pad 22(*a*). The liquid can be part of a chemical slurry that also includes abrasive particles or the microcolumns can be made abrasive so that the liquid is not part of a slurry. Because the elongated microcolumns 24 are distributed substantially uniformly across the planarizing surface 28, the porosity of the polishing pad 22(*a*) is substantially uniform across the entire planarizing surface 28. The uniform porosity provided by the uniformly distributed elongated pores 32 enables the polishing pad 22(*a*) to planarize the semiconductor wafers substantially uniformly across the planarizing surface 28.

The polishing pad 22(*a*) can be made by embedding in the matrix material 26 elongated microcolumns that are already hollow, and thus, already include the elongated pores 32. Alternatively, the hollow elongated microcolumns 24 can be made by using elongated microcolumns each having an elongated central core of a first material positioned within an elongated outer tube of a second material. After the matrix material is cured, the polishing pad 22(*a*) can be exposed to a solvent that dissolves the microcolumn cores to produce the elongated cores 32 without dissolving the elongated outer support tubes 30. For example, such an elongated core 32 can be made using a crystalline carbon fiber as the central core, fiberglass as the elongated outer support tube 30, and concentrated sulfuric acid to dissolve the carbon fiber central core without dissolving the fiberglass support tube.

During the CMP process, the planarizing surface 28 of the polishing pad 22(*a*) becomes polluted with the material taken from the semiconductor wafers. As a result, the polishing pad 22(*a*) must be periodically conditioned by removing the planarizing surface 28 to expose a new planarizing surface. The substantially parallel orientation of the elongated microcolumns 24 ensures that the new planarizing surface exposed by the conditioning process is substantially identical to the old planarizing surface 28 before being polluted by the semiconductor wafer material. As a result, the polishing rate provided by the polishing pad 22(*a*) remains substantially constant throughout the life of the polishing pad 22(*a*).

Figure 4:
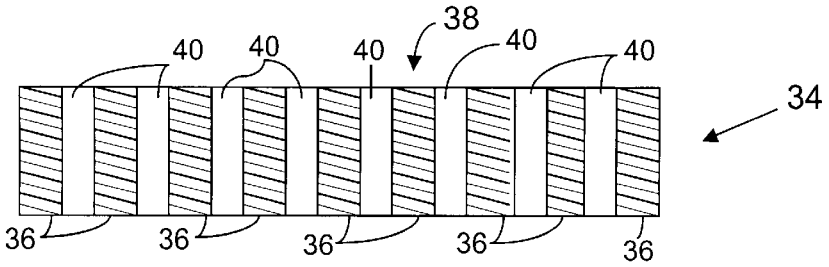
FIG. 4 is a partial cross-sectional view of an alternate polishing pad according to the present invention.

A cross-sectional view of an alternate polishing pad 34 is shown in FIG. 4. The polishing pad 34 includes a matrix material body 36 having a flat planarizing surface 38 for planarizing the semiconductor wafers. Extending perpendicularly from the planarizing surface 38 into the matrix material body 34 are a multiplicity of elongated pores 40. Like the elongated pores 32 shown in the embodiment of FIG. 3, the elongated pores 40 enable liquid from the CMP process to extend into the elongated pores 40 when the polishing pad is used to planarize the semiconductor wafers. The elongated pores 40 can be created by embedding elongated microcolumns, like the elongated microcolumns 24 shown in FIGS. 2 and 3, into the matrix material 36 and then dissolving the elongated microcolumns with a solvent, such as hydrofluoric acid (HF). Embedding elongated microcolumns in the matrix material 36 ensures that the elongated pores 40 resulting from the dissolution of the elongated microcolumns are uniformly distributed. Such uniform distribution of elongated pores 40 results in the polishing pad 34 being uniformly porous, which helps ensure a constant polishing rate for the polishing pad.

Accordingly, the polishing pad 34 is substantially identical to the polishing pad 22(*a*) shown in FIG. 3 except that the polishing pad 34 does not retain the outer support tubes 30, and therefore, the polishing pad 34 is less rigid and more porous than the polishing pad 22(*a*).

Figure 5:
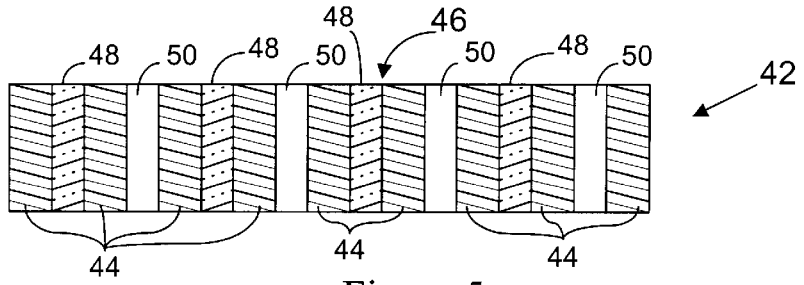
FIG. 5 is a partial cross-sectional view of another alternate polishing pad according to the present invention.

A cross-sectional view of a third CMP polishing pad 42 is shown in FIG. 5. The polishing pad 42 includes a matrix material body 44 having a flat planarizing surface 46 for planarizing semiconductor wafers. Extending inwardly from the planarizing surface 46 are a multiplicity of elongated microcolumns 48 interspersed with a multiplicity of elongated pores 50. Like the embodiment shown in FIG. 3, the microcolumns 48 and the pores 50 preferably extend perpendicularly into the matrix material body 44 from the planarizing surface 46 such that the microcolumns 48 and the pores 50 are parallel to each other substantially along their entire lengths. The elongated microcolumns 48 and the elongated pores 50 are uniformly distributed throughout the polishing pad 42 such that the rigidity and porosity of the polishing pad remain constant throughout the life of the polishing pad.

The polishing pad 42 can be made by embedding two sets of microcolumns in the matrix material 44 with each set of microcolumns being made of a different material. After the matrix material is cured into the matrix material body 44, the polishing pad 42 can be subjected to a solvent that dissolves the first set of microcolumns to produce the elongated pores 50 without dissolving the second set of microcolumns 48 or the matrix material body 44. For example, if the microcolumns in the first set are made of carbon fiber, the microcolumns in the second set are made of fiberglass, and the polishing pad 42 is subjected to concentrated sulfuric acid, the carbon fibers will dissolve to produce the elongated pores 50 while the fiberglass microcolumns remain undissolved as the elongated microcolumns 48. Of course, those skilled in the art will understand that numerous materials can be used for the first and second sets of microcolumns and that numerous other solvents can be employed to selectively dissolve some of the microcolumns. In addition, the number of microcolumns in each set (of the two or more sets) could be varied as necessary to tailor the rigidity, porosity, and abrasiveness of the polishing pad 42 to the requirements of the CMP process being employed.

Figure 6:
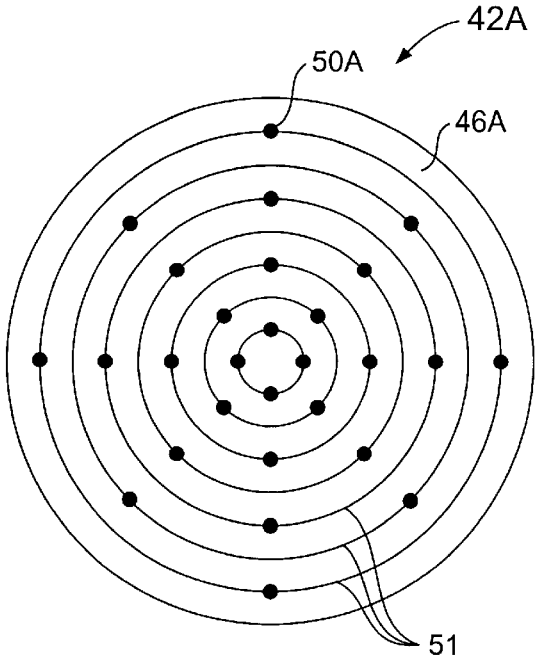
FIG. 6 is an elevational view of a polishing pad with grooves according to the present invention.

An elevational view of an alternate polishing pad 42A is shown in FIG. 6. Like the polishing pads 22(*a*), 34, and 42 shown in FIGS. 3–5, the alternate polishing pad 42A includes a multiplicity of uniformly-spaced, elongated pores 50A. Further, the alternate polishing pad 42A includes a set of grooves 51 milled into a planarizing surface 46A of the alternate polishing pad. Each of the grooves 51 preferably is from 1 to 2000 microns deep and from 1 to 1000 microns in diameter. The grooves 51 shown in FIG. 6 are concentric circles, but numerous other orientations can be employed such as concentric rectangles, parallel lines, etc. The grooves 51 enable the liquid used in the CMP process to travel between the elongated pores 50A and thereby increase the porosity of the alternate polishing pad 42A.

Figure 7:
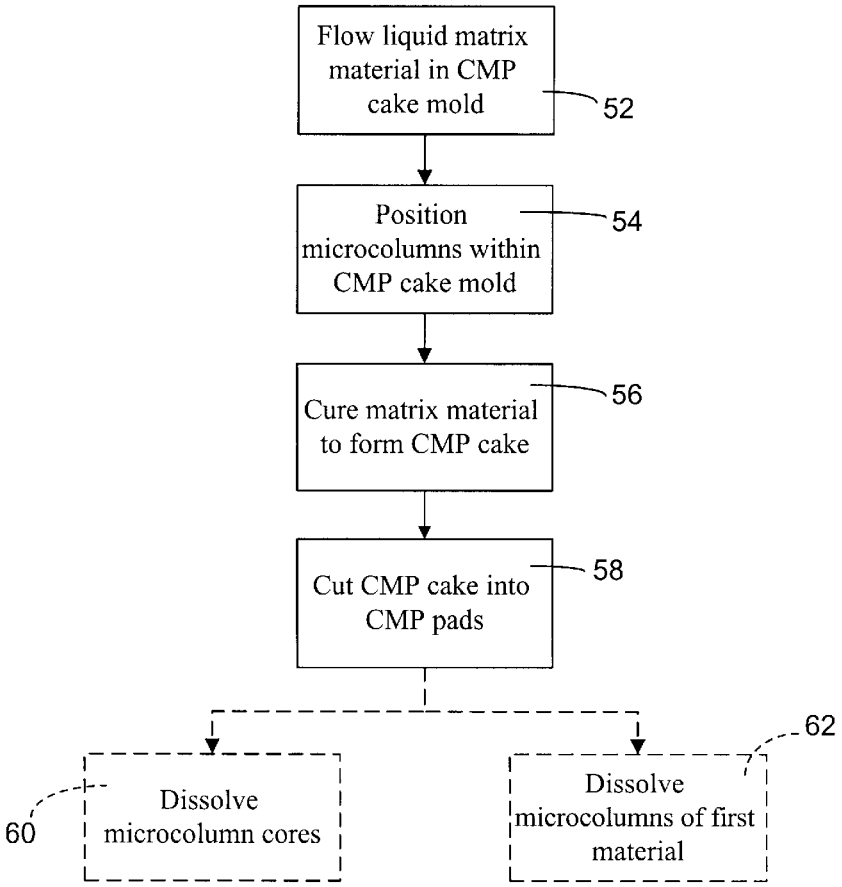
FIG. 7 is a flow diagram of a method for making a polishing pad according to the present invention.

A flowchart of a method for making a CMP polishing pad according to the present invention is shown in FIG. 7. The method includes flowing liquid matrix material into a CMP cake mold in step 52. In step 54 a plurality of elongated microcolumns are positioned within the CMP cake mold such that the liquid matrix material extends between and surrounds the microcolumns. It should be appreciated that the order of the steps 52 and 54 can be reversed so that the microcolumns are positioned in the mold first and then the liquid matrix material flows into the cake mold around the microcolumns. After the CMP cake mold is filled with the liquid matrix material and the microcolumns, the matrix material is cured to form a CMP polishing pad cake in step 56. After curing, the polishing pad cake is cut into a plurality of CMP polishing pads in step 58. If the elongated microcolumns positioned in the CMP cake mold in step 54 are already hollow as shown in FIG. 3, then the polishing pad manufacturing process can end with step 58. Alternatively, the hollow microcolumns 24 can be made using elongated microcolumns with an elongated central core of a first material positioned within an elongated outer tube of a second material. If such two-part microcolumns are used, then in step 60 the polishing pad is exposed to a solvent to dissolve the microcolumn cores and thereby produce elongated pores 32 within the elongated outer support tubes 30 of the microcolumns 24.

A similar process can be used to create the polishing pad 42 shown in FIG. 5. In step 54 the microcolumns positioned within the CMP cake mold would include a first set of microcolumns made of a first material interspersed with a second set of microcolumns made of a second material. After the matrix material is cured in step 56 and after the CMP cake is cut into polishing pads in step 58, the polishing pad can be exposed to a solvent material that removes the first material without removing the second material and the matrix material in step 62. Once again, carbon fibers, fiberglass fibers, and sulfuric acid may be used for the first material, second material, and solvent material, respectively.

Figure 8:
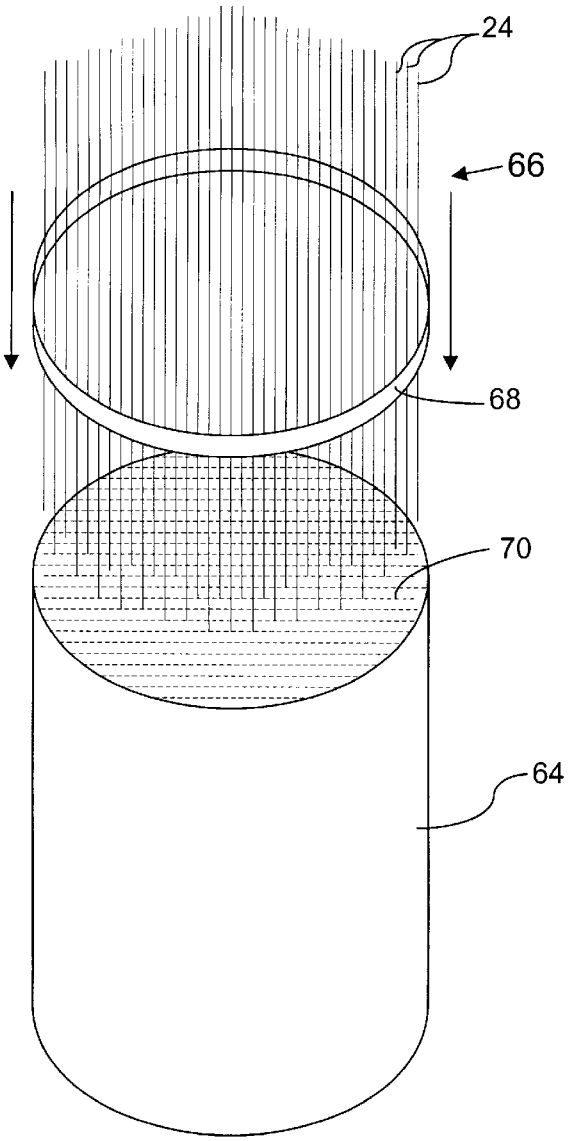
FIG. 8 is an isometric view of elongated microcolumns being inserted into a polishing pad cake mold according to the present invention.

FIG. 8 illustrates one method for positioning the elongated microcolumns 24 within a CMP cake mold 64 according to step 54 (FIG. 7). The elongated microcolumns 24 are coupled to each other as a bundle 66 using a connecting piece 68. Although the microcolumns 24 are shown spaced apart in FIG. 8 for ease of illustration, the actual microcolumns 24 would be more closely bundled together. The bundle 66 of microcolumns is inserted into the cake mold 64 that already holds the liquid matrix material 70. After the bundle 66 is fully within the CMP cake mold 64, the connecting piece 68 can be removed and the matrix material is cured.

Figure 9:
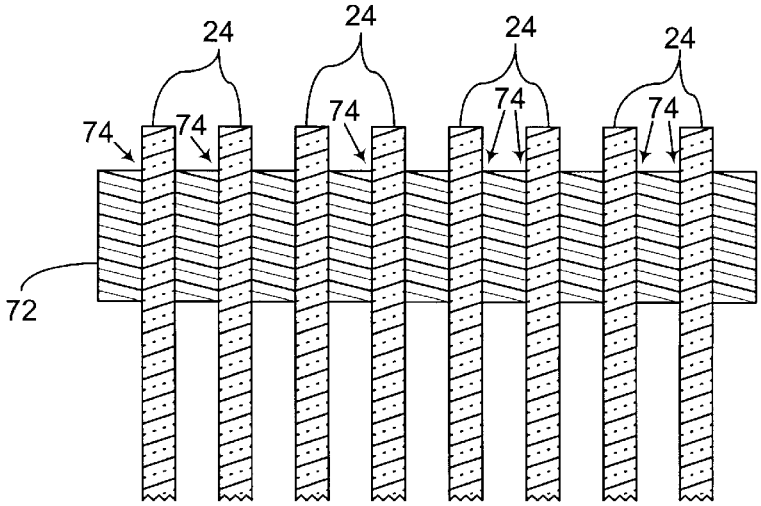
FIG. 9 is a cross-sectional view of an alignment fixture maintaining spacing between elongated microcolumns according to the present invention.

An alternate embodiment for positioning the elongated microcolumns 24 within the polymer pad cake mold 64 is to use an alignment fixture 72 having spaced apart apertures 74 through which the elongated microcolumns are passed as shown in FIG. 9. Each elongated microcolumn 24 extends through a separate aperture 74 so that the microcolumns remain parallel to each other while the matrix material in the cake mold cures. Preferably, the alignment fixture 72 is mounted on the top of the CMP cake mold 64 so that the elongated microcolumns 24 extend through the apertures 74 directly into the CMP cake mold 64.

The many advantages of the present invention will be appreciated based on the foregoing discussion. In particular, by uniformly distributing the elongated microcolumns throughout a matrix material, the present invention provides a polishing pad having a constant polishing rate throughout the planarizing surface of the polishing pad. In addition, the uniform distribution of the elongated microcolumns enables the polishing pad to have a constant polishing rate throughout the life of the polishing pad. Furthermore, the ease of making each polishing pad with uniformly distributed microcolumns enables every polishing pad to exhibit substantially identical polishing characteristics. Conversely, the polishing characteristics can be altered easily and precisely from one polishing pad to another.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method of making a chemical-mechanical planarizing polishing pad for planarizing semiconductor wafers, the method comprising:

positioning a plurality of parallel, uniformly distributed, elongated solid microcolumns within a mold;

placing a liquid matrix material within the mold, the liquid matrix material extending between the microcolumns;

curing the matrix material to form a pad body with the microcolumns interspersed within the cured matrix material; and dividing the pad body, including the solid microcolumns, into a plurality of polishing pads after the matrix material is cured.

2. The method of claim 1 wherein the microcolumns include a first set and a second set of microcolumns, the first and second sets being interspersed with respect to each other, the first set of microcolumns being made of a first material and the second set of microcolumns being made of a second material, and the method further includes exposing the pad body to a material that removes the first material without removing the second material and the matrix material, thereby creating elongated pores between the microcolumns of the second set.

3. The method of claim 1 wherein the liquid matrix material is placed within the mold before the microcolumns are positioned within the mold.

4. The method of claim 1 wherein the microcolumns are coupled to each other by a connecting piece and the positioning step includes positioning the microcolumns within the mold as a bundle and the method further includes detaching the connecting piece from the microcolumns after the matrix material has cured.

5. The method of claim 1 wherein the positioning step includes maintaining the microcolumns spaced with respect to each other by extending the microcolumns through spaced-apart apertures in an alignment fixture, each microcolumn extending through a separate aperture of the spaced-apart apertures.

6. The method of claim 1, further comprising milling a groove into a planarizing surface of at least one of the polishing pads to enable liquid used in chemical-mechanical planarization to travel within the groove.

7. The method of claim 1, further comprising milling a plurality of concentric grooves into a planarizing surface of at least one of the polishing pads to enable liquid used in chemical-mechanical planarization to travel within the grooves.

8. The method of claim 1 wherein the positioning step includes positioning the solid microcolumns substantially entirely from one end of the mold to an opposite end of the mold such that the solid microcolumns extend substantially entirely through each of the polishing pads after the matrix material is cured.

* * * * *